US006176600B1

(12) United States Patent
Huang

(10) Patent No.: US 6,176,600 B1
(45) Date of Patent: Jan. 23, 2001

(54) DECORATIVE LIGHTING NET

(76) Inventor: Ming-Hsien Huang, No. 2, Lane 65, Cheng Kong Road, Hsinchu (TW)

( * ) Notice: Under 35 U.S.C. 154(b), the term of this patent shall be extended for 0 days.

(21) Appl. No.: 09/478,469

(22) Filed: Jan. 6, 2000

(51) Int. Cl.[7] ..... F21V 21/00
(52) U.S. Cl. ..... 362/396; 362/249; 362/806
(58) Field of Search ..... 362/226, 249, 362/252, 391, 396, 806

(56) References Cited

U.S. PATENT DOCUMENTS 3,927,315 * 12/1975 Werry ..... 362/249
5,513,081 * 4/1996 Byers ..... 362/249
5,626,419 * 5/1997 Lin ..... 362/391
5,727,872 * 3/1998 Liou ..... 362/252

* cited by examiner

*Primary Examiner*—Y. Quach
(74) *Attorney, Agent, or Firm*—Rosenberg, Klein & Lee

(57) ABSTRACT

A decorative lighting net includes a plurality of intersecting electrical wires accompanied by a plurality of bulb units. By use of larger type bulbs, the net can provide a better lighting decorative effect. Each bulb unit includes a cap engaged with a bulb holder that secures a pair of wires to the bulb holder. The cap has a pair of hooks extending from a rear of the cap for engagement with a connector provided around other wires, to obtain a secure connection of the bulb units at the intersections of the wires for providing the decorative lighting net.

1 Claim, 4 Drawing Sheets

DECORATIVE LIGHTING NET

A conventional decorative lighting net is comprised of several lighting strings with an electrical wire and a plurality of miniature bulb units, wherein the wires are intercrossed and connected with bulb holders. The known miniature bulb cannot provide enough lighting. When a conventional lighting net is used at a wide place, it cannot provide a desired decorative effect always and should be improved.

SUMMARY OF THE INVENTION

In view of the problem, it is a primary object of the invention to provide a decorative lighting net which is provided with a bulb unit having a larger bulb that can be connected with the electrical wires with ease and secured in a lighting net for a better decorative effect and improvement over the prior art.

Now the features and advantages of the invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
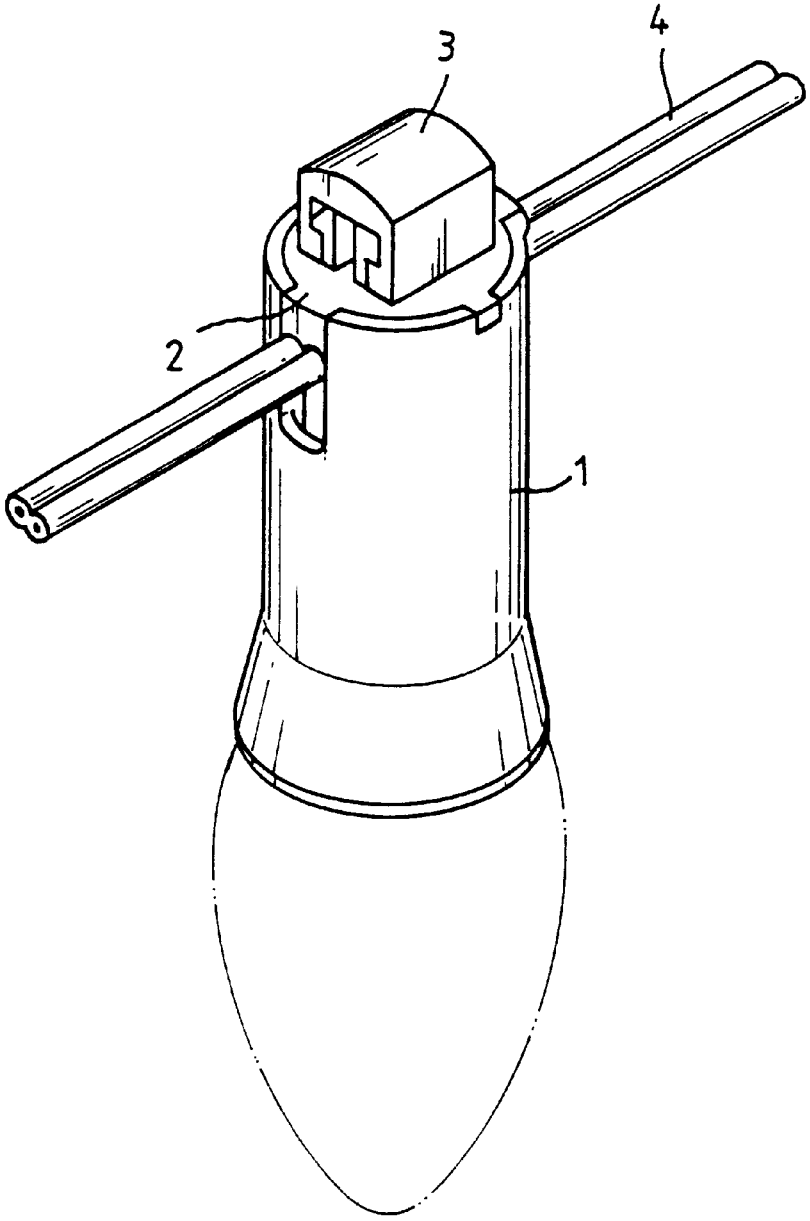
FIG. 1 is a perspective view illustrating the structure of a bulb unit according to the invention.
Figure 2:
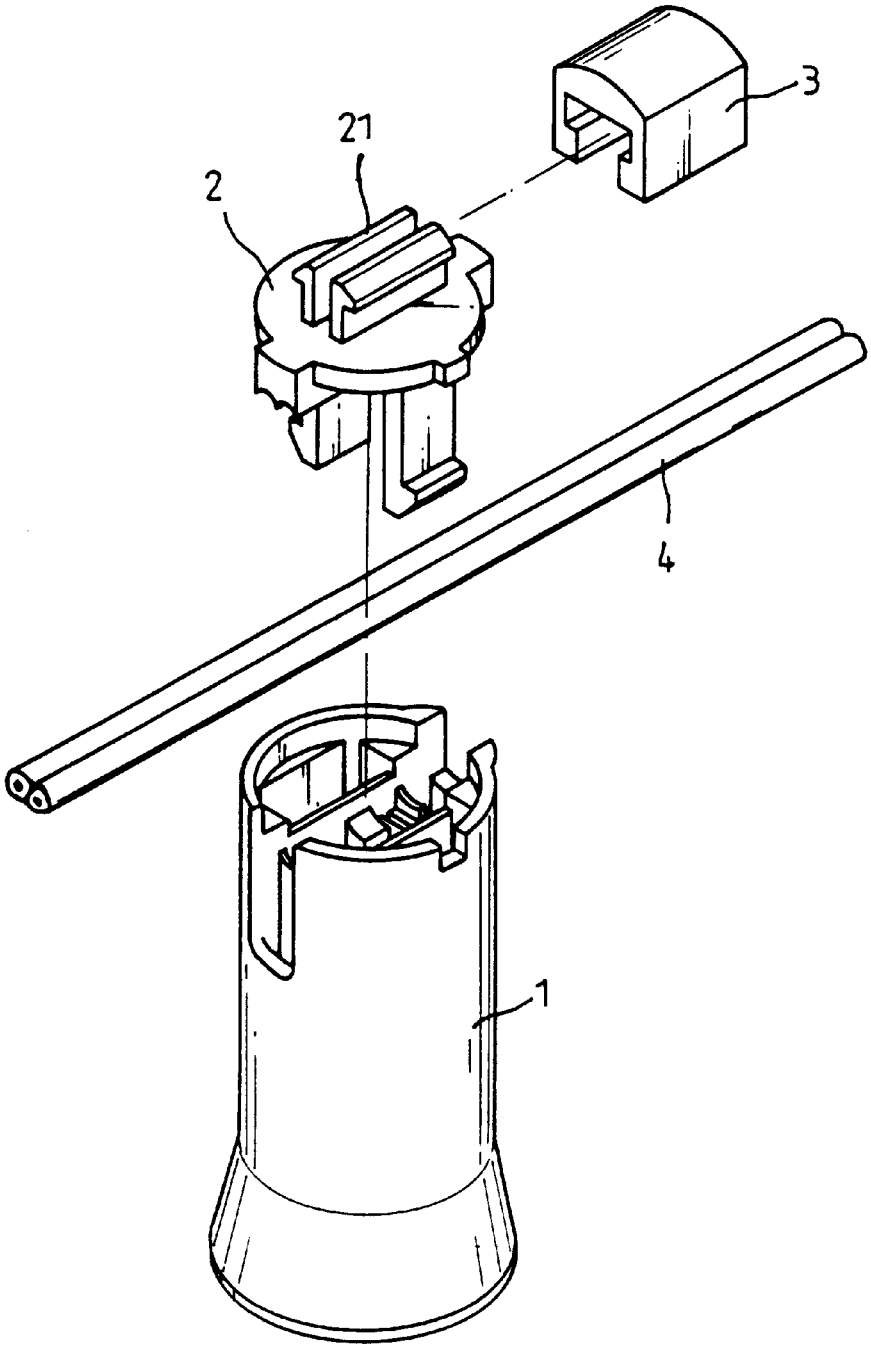
FIG. 2 is an exploded perspective view of FIG. 1.

Referring to FIGS. 1 to 2, the present invention is to provide a bulb unit being used on a decorative net, which includes a bulb holder (1) with a cap (2) having a pair of hooks (21) thereon. An electrical wire (4) of the net is capable of passing through the space between two hooks (21). A connector (3) is slidably provided around the wire (4) and can be moved to engage with the hooks (21) firmly that makes the wire (4) and the cap (2) engaged with the bulb holder (1) becoming a single connecting body having enough connecting strength, as in FIG. 1.

Figure 3:
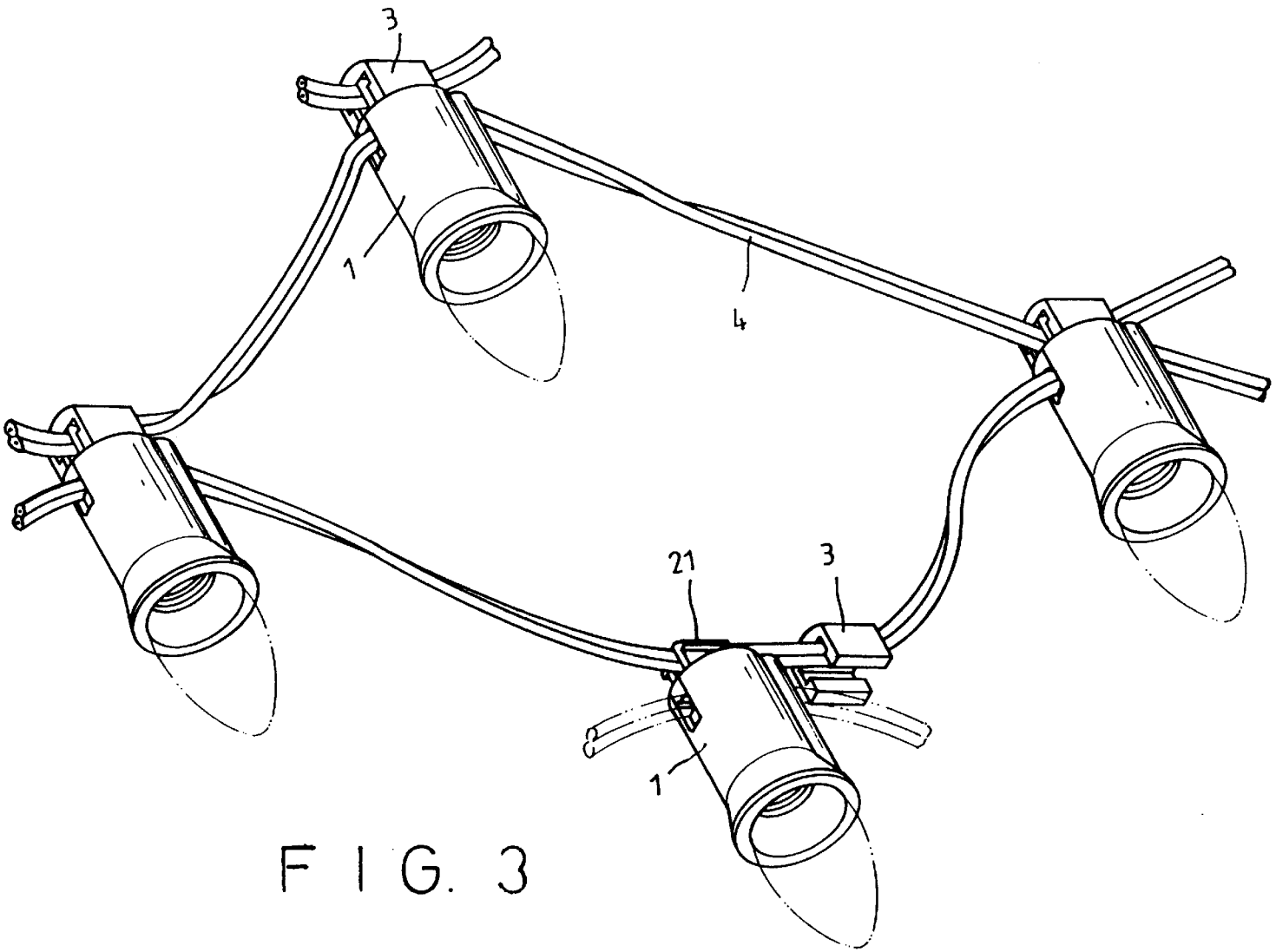
FIG. 3 is a schematic view indicating an assembly of the bulb units with electrical wires of this invention.
Figure 4:
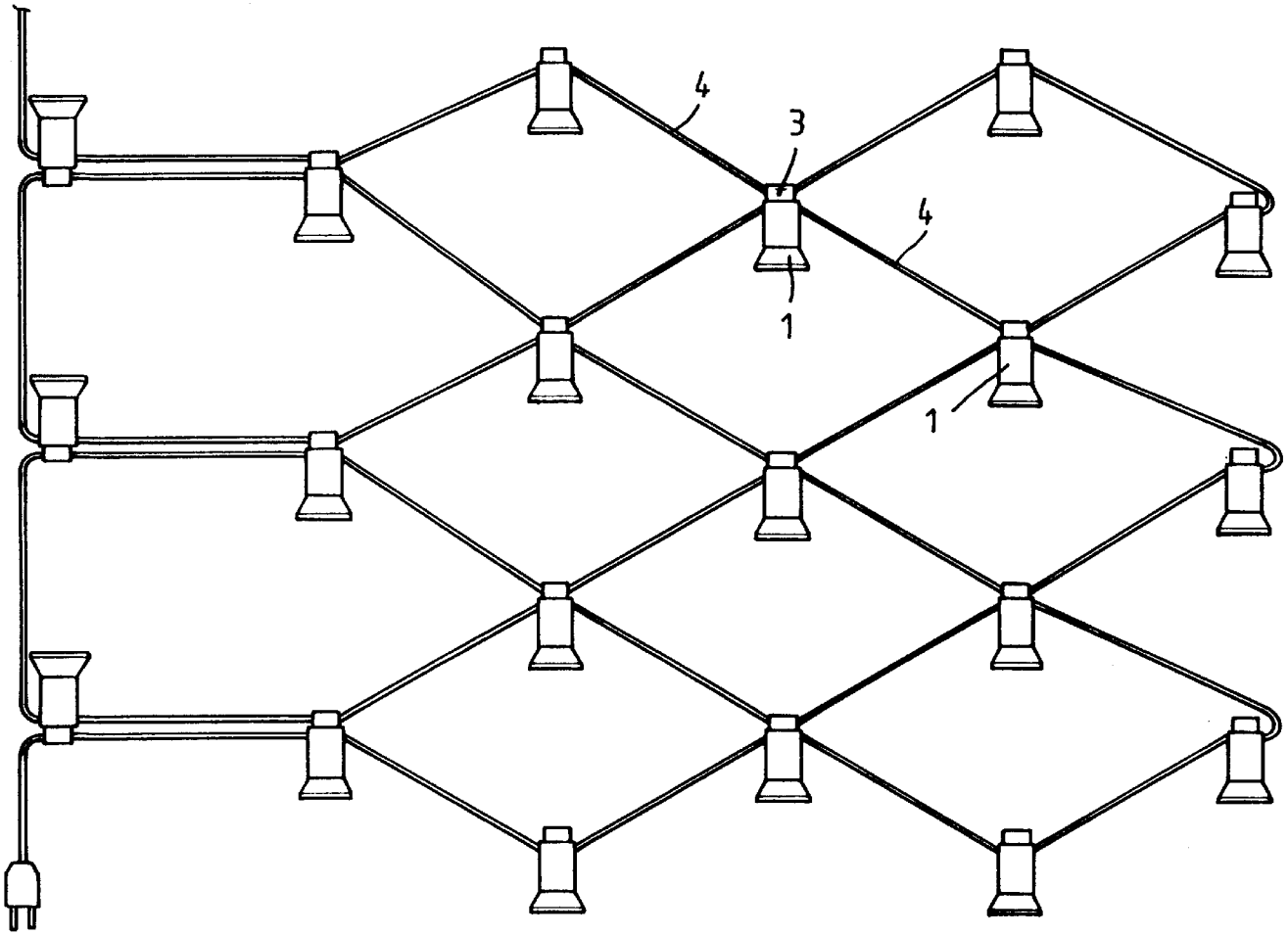
FIG. 4 is a plan view depicting a decorative lighting net according to the present invention.

When many bulb units are connected with the electrical wires (4), it can be found that a decorative lighting net with bulb units is thus formed, as shown in FIGS. 3 and 4. Since the bulbs with larger bulbs can provide a better lighting effect, the lighting net according to the present invention can display a better decorative effect. In the meantime, the connection between the electrical wires (4) and the bulb units is very easy to make and firmly secured.

In summary, the present invention provides a decorative lighting net with an inventive structure and providing a better utility. It has superiority over prior art net structures obviously.

What is claimed is:

1. A decorative lighting net, comprising:

a plurality of electrical wires arranged in intersecting relationship to define a net with a plurality of nodes; and, a plurality of bulb units respectively secured to said plurality of nodes, each of said plurality of bulb units including:

a. a bulb holder having an open cavity formed in a first end thereof for receiving a light bulb therein and a channel formed in an opposing second end of said bulb holder for receiving a pair of said plurality of electrical wires therein;

b. a cap engaged to said second end of said bulb holder for forming a closure for said channel, said cap having a pair of longitudinally elongated hooks extending from a rear side of said cap in back-to-back spaced relationship to define an electrical wire receiving space therebetween; and, c. a longitudinally extended connector slidingly engaged with said pair of hooks to form a closure for said electrical wire receiving space, wherein each said node is defined by respective electrical wires being secured in said channel and said electrical wire receiving space of a corresponding bulb unit.

* * * * *